US008827737B2

(12) United States Patent
Makino

(10) Patent No.: US 8,827,737 B2
(45) Date of Patent: Sep. 9, 2014

(54) SPLIT CONNECTOR

(75) Inventor: Kenji Makino, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 550 days.

(21) Appl. No.: 12/879,188

(22) Filed: Sep. 10, 2010

(65) Prior Publication Data

US 2011/0076093 A1 Mar. 31, 2011

(30) Foreign Application Priority Data

Sep. 25, 2009 (JP) ..... 2009-220564

(51) Int. Cl.

*H01R 13/627* (2006.01)
*H01R 13/506* (2006.01)
*H01R 13/516* (2006.01)
*H01R 13/514* (2006.01)

(52) U.S. Cl.

CPC ..... *H01R 13/516* (2013.01); *H01R 13/506* (2013.01); *H01R 13/514* (2013.01)
USPC ..... 439/357; 439/358; 439/532

(58) Field of Classification Search

CPC ... H01R 13/506; H01R 13/514; H01R 13/516
USPC ..... 403/329; 439/357, 358, 701, 532
See application file for complete search history.

(56) References Cited

U.S. PATENT DOCUMENTS

| | | | | |
|---|---|---|---|---|
| 4,637,674 | A | 1/1987 | Kobler | |
| 5,104,253 | A * | 4/1992 | Zielinski et al. | 403/329 |
| 5,484,301 | A | 1/1996 | Koumatsu et al. | |
| 6,368,132 | B1 | 4/2002 | Okayasu | |
| 6,669,398 | B2 * | 12/2003 | Wada et al. | 403/329 |
| 7,261,575 | B2 * | 8/2007 | Buchter et al. | 439/157 |
| 7,287,994 | B1 | 10/2007 | Liao | |
| 7,438,568 | B2 | 10/2008 | Nishide et al. | |
| 2006/0194469 | A1 * | 8/2006 | Miyakawa et al. | 439/357 |
| 2006/0205262 | A1 * | 9/2006 | Buchter et al. | 439/358 |
| 2009/0111318 | A1 | 4/2009 | Horiuchi et al. | |
| 2009/0209127 | A1 | 8/2009 | Carmitchel | |

FOREIGN PATENT DOCUMENTS

| | | |
|---|---|---|
| EP | 1746689 A1 * | 1/2007 |
| JP | 2007-141678 | 6/2007 |

* cited by examiner

*Primary Examiner* — Victor MacArthur
(74) *Attorney, Agent, or Firm* — Gerald E. Hespos; Michael J. Porco; Matthew T. Hespos

(57) ABSTRACT

An auxiliary housing (20) inserted into a frame (10) is locked in a retained state by the locking action of resiliently deformable lock arms (13) and locks (21). The lock arms (13) and the locks (21) include locking surfaces (17, 23) that are substantially normal to an inserting direction of the auxiliary housing (20) and come into contact with each other with the lock arms (13) and the locks (21) engaged in an insertion process of the auxiliary housing (20). When an inserting force exceeding a locking force of the locking surfaces (17, 23) is applied to the auxiliary housing (20), the lock arms (13) are resiliently deformed to disengage the locking surfaces (17, 23).

5 Claims, 7 Drawing Sheets

SPLIT CONNECTOR

BACKGROUND OF THE INVENTION

1. Field of the Invention

The invention relates to a split connector.

2. Description of the Related Art

Japanese Unexamined Patent Publication No. 2007-141678 discloses a split connector with a frame that has an accommodation space. Two resiliently deformable lock arms are provided in the frame and face the accommodation space. An auxiliary housing is inserted into the accommodation space and two locks are provided on the auxiliary housing. The auxiliary housing is inserted into the accommodation space and is locked in a retained state by the locking action of the lock arms and the locks.

Only one lock arm and one lock may engage if the auxiliary housing is inserted obliquely into the frame, and the other lock arm and lock may be left unengaged.

The invention was developed in view of the above situation and an object thereof is to engage two lock arms and two lock portions reliably for locking an auxiliary housing inserted into a frame in a retained state.

SUMMARY OF THE INVENTION

The invention relates to a split connector that has a frame and at least one auxiliary housing to be inserted into the frame. At least one resiliently deformable lock arm is provided on one of the frame and the auxiliary housing, and at least one lock is provided on the other of the frame and the auxiliary housing. The auxiliary housing is inserted into the frame and is locked in a retained state by the locking action of the lock arms and the locks. At least one resiliently deformable resistance arm is provided on one of the frame and the auxiliary housing and a resistance generating portion is provided on the other of the frame and the auxiliary housing. The resistance arm and the resistance generating portion include locking surfaces that are substantially normal to an inserting direction of the auxiliary housing and contact each other without the lock arms and the locks being engaged with each other during a process of inserting the auxiliary housing. The resistance arm is deformed resiliently to disengage the locking surfaces by applying an inserting force to the auxiliary housing that exceeds a locking force of the locking surfaces.

The engagement of the locking surfaces of the resistance arm and the resistance generating portion hinders insertion of the auxiliary housing into the frame. However, the resistance arm resiliently deforms to disengage the locking surfaces when an inserting force exceeding the locking force of the locking surfaces is applied to the auxiliary housing. The applied inserting force swiftly moves the auxiliary housing to a properly inserted state. Hence, resistance resulting from resilient deformations of the lock arms will not hinder insertion of the auxiliary housing, and the lock arms reliably engage the locks to lock the auxiliary housing.

The lock arms and the locks have locking surfaces that contact each other.

The lock arms preferably double as the resistance arms and the locks preferably double as the resistance generating portions. Thus, the structures of the frame and the auxiliary housing can be simplified.

The lock arms and the locks preferably have sliding-contacts that slide in contact with each other with the lock arms resiliently deformed.

The sliding-contacts of the lock arms or the sliding-contacts of the locks have guiding slopes oblique to the inserting direction of the auxiliary housing.

A pressing force in the inserting direction preferably is applied to the auxiliary housing by resilient restoring forces of the lock arms and inclinations of the guiding slopes during insertion of the auxiliary housing. Thus, the auxiliary housing can reliably reach a proper insertion position.

An end surface of the lock preferably defines a substantially flat fixed locking surface that is substantially normal to the inserting direction of the auxiliary housing into the frame and/or an extending direction of the lock arms in a state where the auxiliary housing is in a proper posture with respect to the frame.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
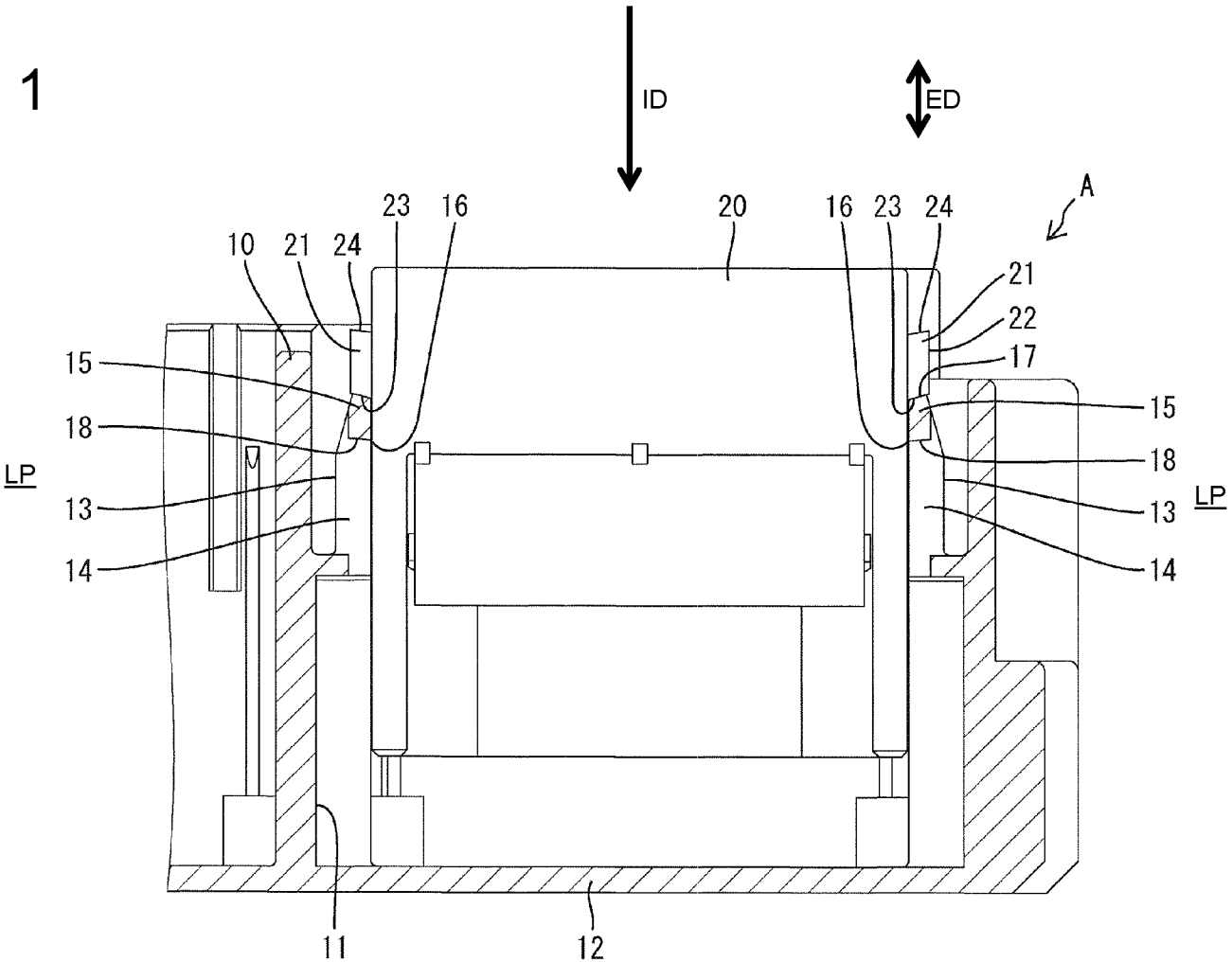
FIG. 1 is a section showing a state where insertion of an auxiliary housing is hindered by engagement of locking surfaces in a split connector of a first embodiment.
Figure 2:
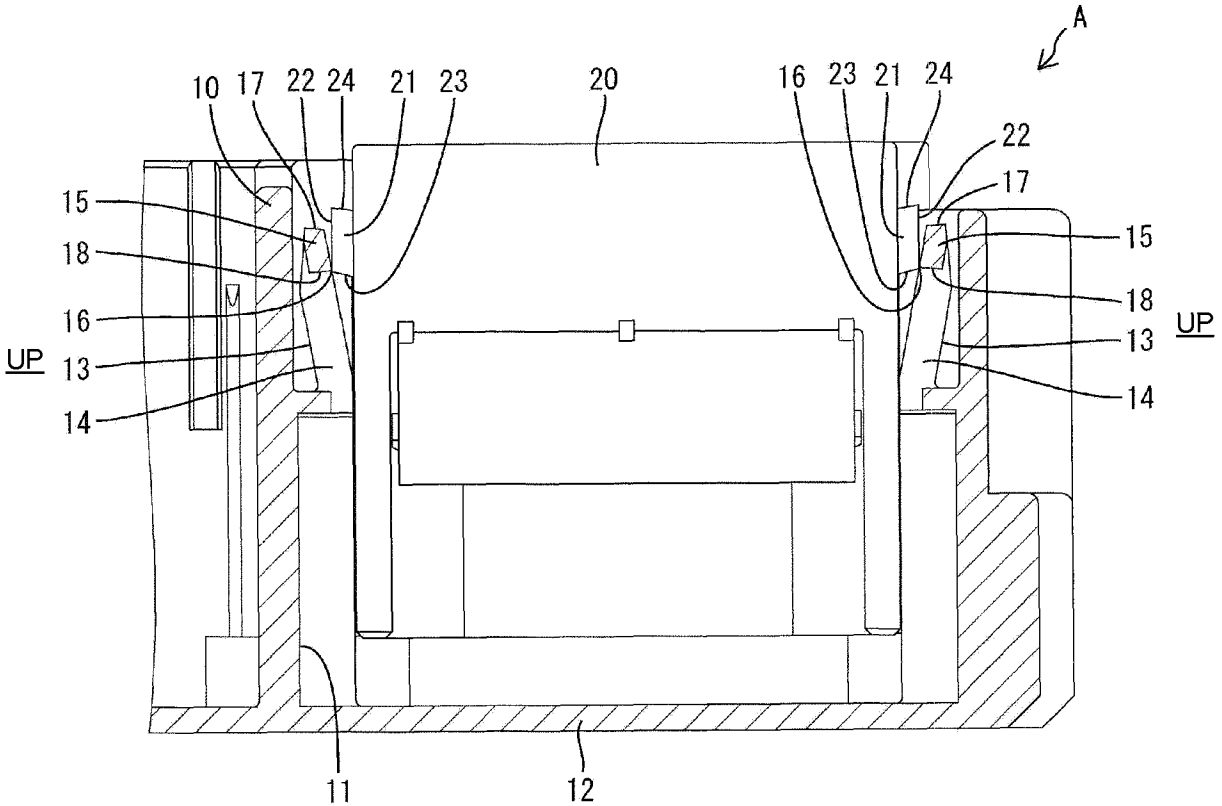
FIG. 2 is a section showing a state where the insertion of the auxiliary housing is in progress after the locking surfaces are disengaged.
Figure 3:
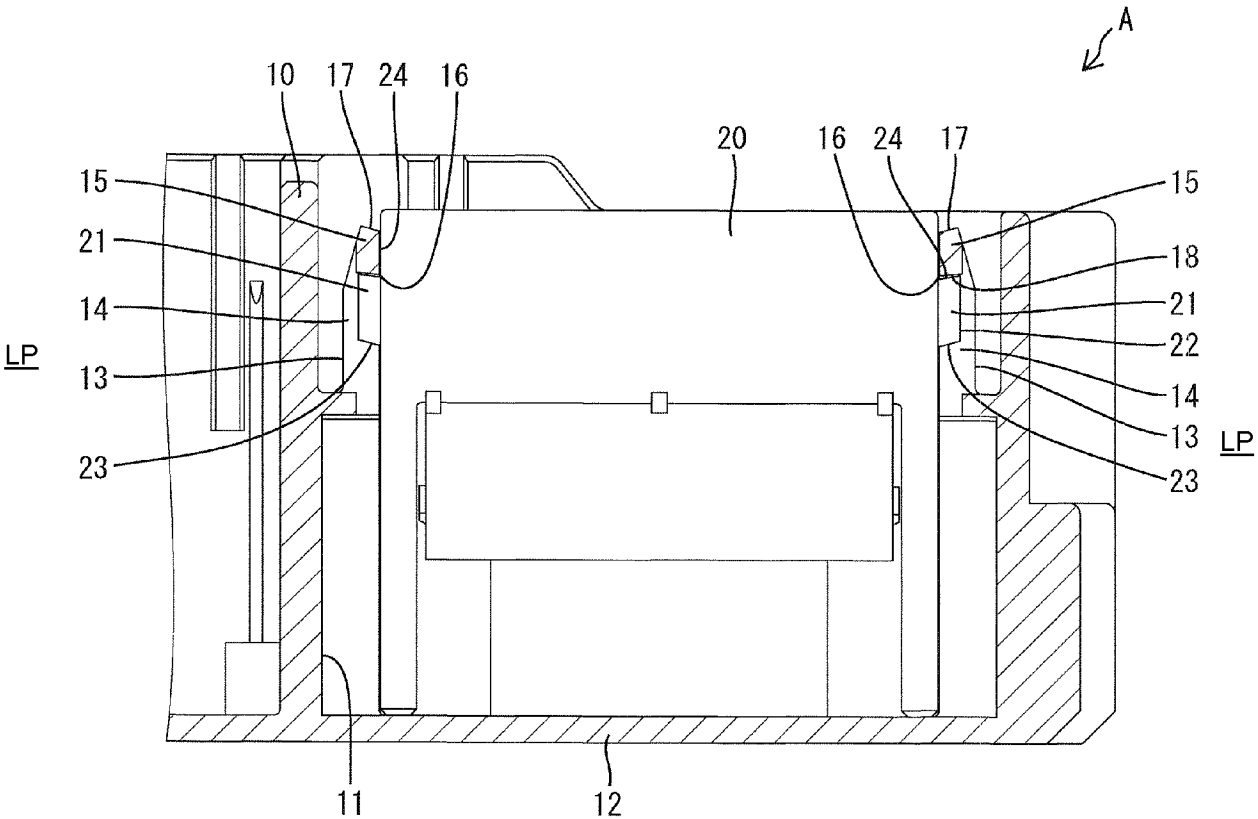
FIG. 3 is a section showing a state where the auxiliary housing is properly inserted in an accommodation space of a frame and locked in a retained state by the engagement of lock arms and lock portions.
Figure 4:
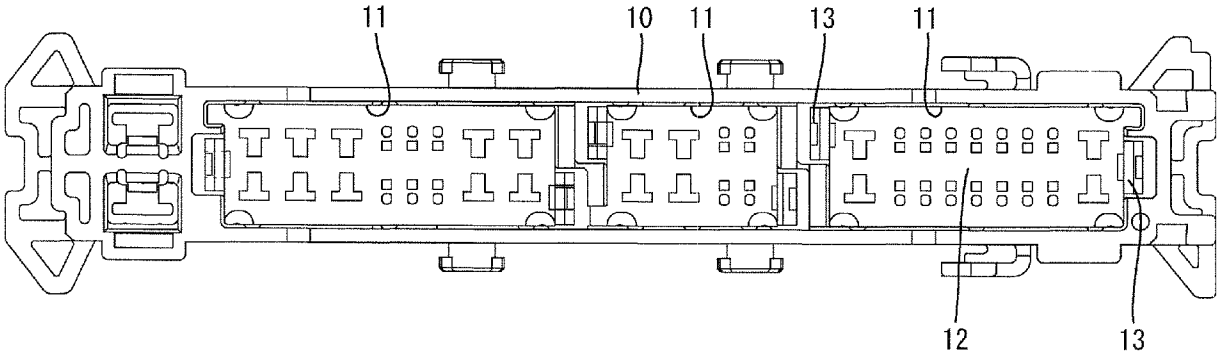
FIG. 4 is a plan view of the frame.
Figure 5:
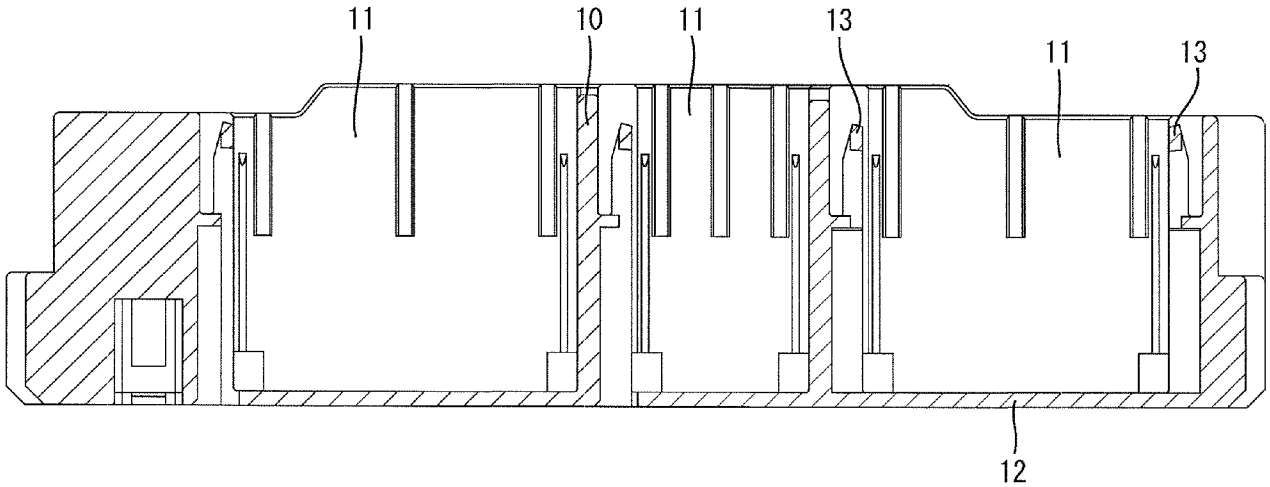
FIG. 5 is a section of the frame.
Figure 6:
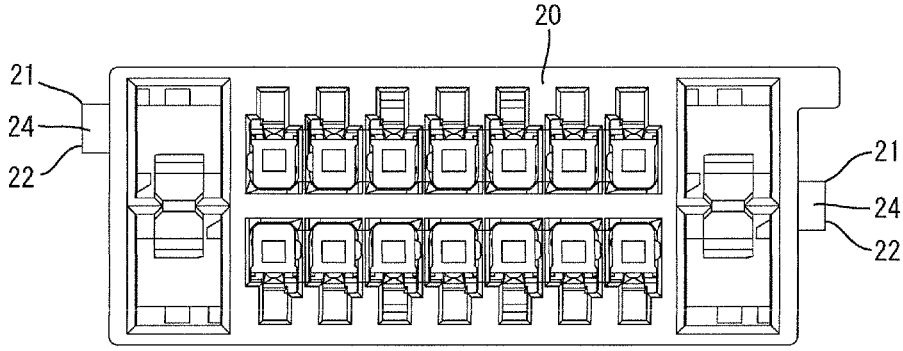
FIG. 6 is a plan view of the auxiliary housing.
Figure 7:
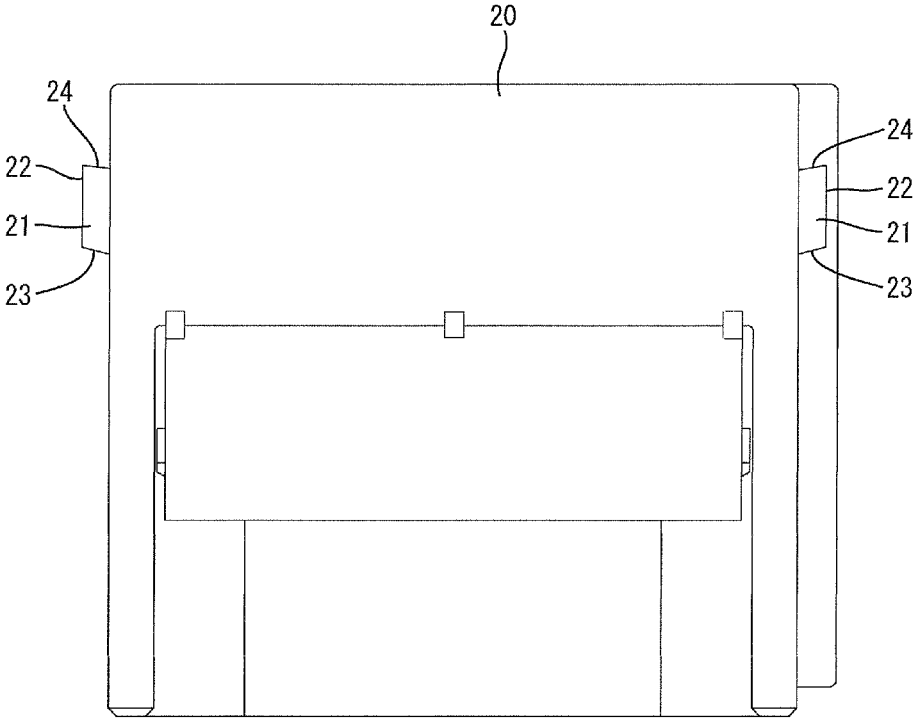
FIG. 7 is a front view of the auxiliary housing.

A split connector in accordance with a first embodiment of the invention is illustrated in FIGS. 1 to 7 and is identified by the letter A. The split connector A has a frame 10 made e.g. of synthetic resin and auxiliary housings 20 made e.g. of synthetic resin.

The frame 10 is wide and accommodation spaces 11 are arranged laterally in the frame 10. Each accommodation space 11 opens in the upper surface of the frame 10, and a front-stop wall 12 is provided on the bottom end of the accommodation space 11. Left and right lock arms 13 are formed unitarily in the rightmost accommodation space 11 in FIGS. 4 and 5. The right lock arm 13 is substantially in the center of the accommodation space 11 with respect to forward and backward directions (vertical direction in the plan view of FIG. 4). The left lock arm 13 is displaced slightly back from the center of the accommodation space 11 with respect to forward and backward directions. The left and right lock arms 13 also function as resistance arms.

The left and right lock arms 13 project up from the inner surfaces of the left and right walls of the accommodation space 11 and extend substantially parallel to an inserting direction ID of the auxiliary housing 20 into the accommodation space 11. Lock holes 14 laterally penetrate upper extending ends of the respective lock arms 13. Each lock arm 13 normally is held at a locking position LP (see FIGS. 1 and 3) due to its own rigidity, but is resiliently deformable and displaceable laterally out and away from the mating lock arm 13 to an unlocking position UP (see FIG. 2) with a lower base end as a support.

A lock 15 is defined in an extending upper end of the lock arm 13 in an area above the lock hole 14. A movable sliding-contact 16 is defined in upper end edge of the opening edge of the lock hole 14 to face the mating lock arm 13 and also to face an outer side surface of the auxiliary housing 20 inserted into the accommodation space 11 of the lock 15.

A flat movable locking surface 17 is formed at the upper end of the lock 15. The movable locking surface 17 is substantially normal to an extending direction ED of the lock arm 13 and the inserting direction ID of the auxiliary housing 20 into the accommodation space 11 in a state where the lock arm 13 is at the locking position LP. Specifically, the movable locking surface 17 is inclined slightly down from an outer (side toward the unlocking position UP) lateral edge toward an inner lateral edge. The left and right movable locking surfaces 17 are at substantially the same height in a vertical inserting direction ID of the auxiliary housing 20 into the accommodation space 11.

A flat movable lock surface 18 is formed at the lower end of the lock 15 and faces into the lock hole 14. The movable lock surface 18 is substantially normal to the extending direction ED of the lock arm 13 and the inserting direction ID of the auxiliary housing 20 into the accommodation space 11 in the state where the lock arm 13 is at the locking position LP. Specifically, the movable lock surface 18 inclines slightly down from an outer lateral edge (side toward the unlocking position UP) toward an inner lateral edge. The left and right movable lock surfaces 18 are at the substantially same height in the vertical inserting direction of the auxiliary housing 20 into the accommodation space 11. The movable lock surfaces 18 are inclined in the substantially same directions as the corresponding movable locking surfaces 17.

Each auxiliary housing 20 is in the form of a block, and terminal fittings (not shown) are to be accommodated therein. Left and right locks 21 are formed on the outer left and right lateral surfaces of the auxiliary housing 20. The right lock 21 is substantially in the center of the auxiliary housing 20 with respect to forward and backward directions (vertical direction in the plan view of FIG. 4). The left lock 21 is displaced slightly back from the center of the auxiliary housing 20 with respect to forward and backward directions. The left and right locks 21 also function as preferred resistance generating portions.

The left and right locks 21 particularly are blocks that project sideways from the outer side surfaces of the auxiliary housing 20. The right outer surface of the right lock 21 and the left outer surface of the left lock 21 define fixed sliding-contacts 22. The fixed sliding-contacts 22 are substantially flat and parallel to the inserting direction ID of the auxiliary housing 20 into the accommodation space 11 of the frame 10.

A flat fixed locking surface 23 is defined at the bottom of the lock 21. The fixed locking surface 23 is substantially normal to the inserting direction ID of the auxiliary housing 20 into the accommodation space 11 and the extending direction ED of the lock arms 13 when the auxiliary housing 20 is in a proper posture with respect to the accommodation space 11. Specifically, the fixed locking surface 23 inclines slightly down from an outer lateral edge (side distant from the outer side surface of the auxiliary housing 20) toward an inner lateral edge (side close to the outer side surface of the auxiliary housing 20). Thus, the fixed locking surface 23 inclines in the same direction as the corresponding movable locking surface 17 and movable lock surface 18. The left and right fixed locking surfaces 23 are at substantially the same height in the vertical inserting direction ID of the auxiliary housing 20 into the accommodation space 11 when the auxiliary housing 20 is in the proper posture with respect to the accommodation space 11.

A flat fixed lock surface 24 is defined at the upper end of the lock 21. The fixed lock surface 24 is substantially normal to the inserting direction ID of the auxiliary housing 20 into the accommodation space 11 and the extending direction ED of the lock arms 13 in a state where the auxiliary housing 20 is in the proper posture with respect to the accommodation space 11. Specifically, the fixed lock surface 24 inclines slightly down from an outer lateral edge (side distant from the outer side surface of the auxiliary housing 20) toward an inner lateral edge (side close to the outer side surface of the auxiliary housing 20). Thus, the fixed lock surface 24 inclines in the same direction as the corresponding movable locking surface 17, movable lock surface 18 and fixed locking surface 23. The left and right fixed lock surfaces 24 are at substantially the same height in the vertical inserting direction ID of the auxiliary housing 20 into the accommodation space 11 when the auxiliary housing 20 is in the proper posture with respect to the accommodation space 11.

The auxiliary housing 20 is dropped into the accommodation space 11 from above the frame 10 and along the inserting direction ID during an insertion process. As a result, the left and right locks 21 of the auxiliary housing 20 contact the locks 15 of the corresponding lock arms 13 from above, as shown in FIG. 1. Thus, the fixed locking surfaces 23 come into surface contact with the movable locking surfaces 17 for temporarily preventing further insertion of the auxiliary housing 20. At this time, a locking function by the lock arms 13 and the locks 21 is not fulfilled yet.

In this state, the rigidity of the lock arms 13 prevents the lock arms 13 from deforming and maintains the engaged state of the locking surfaces 17, 23 to keep the auxiliary housing 20 in an insertion prevented state, provided that the magnitude of any operation force applied to the auxiliary housing 20 in the inserting direction ID is below a locking force of the locking surfaces 17, 23 caused by frictional resistance between the locking surfaces 17, 23. In other words, large resistance to hinder insertion of the auxiliary housing 20 is generated by the locking action of the lock arms 13 (as the resiliently deformable resistance arms) and the locks 21 (as the resistance generating portions).

An inserting force then is applied to the auxiliary housing 20 in excess of the specified locking force of the locking surfaces 17, 23 caused by the rigidity of the lock arms 13. Thus, the lock arms 13 deform laterally out and away from the outer side surfaces of the auxiliary housing 20 to disengage the locking surfaces 17, 23. The applied inserting force moves the auxiliary housing 20 from the state shown in FIG. 2 to the properly inserted state shown in FIG. 3 when the locking surfaces 17, 23 disengage. The locks 21 then pass the locks 15. As a result, the lock arms 13 resiliently restore to engage the locks 21 and the lock holes 14 and to bring the movable lock surfaces 18 and the fixed lock surfaces 24 into surface contact for holding the properly inserted auxiliary housing 20 in its retained state. The front end surface (lower surface) of the auxiliary housing 20 contacts the front-stop wall 12 to prevent further insertion and to keep the auxiliary housing 20 at a proper insertion position.

The movable sliding-contacts 16 slide on the fixed sliding-contacts 22 after the locking surfaces 17, 23 disengage and a frictional resistance is created due to the resilient restoring forces of the lock arms 13. Frictional resistance between the movable sliding-contacts 16 and the fixed sliding-contacts 22 defines an insertion resistance that hinders the insertion of the auxiliary housing 20. Thus, the auxiliary housing 20 could be inserted obliquely and only one of the left and right lock arms 13 may resiliently restore so that the auxiliary housing 20 is locked only at one side.

However, the inserting force applied to the auxiliary housing 20 to deform the lock arms 13 is relatively large. Thus, the auxiliary housing 20 is inserted swiftly and reaches the properly inserted state at once without being inclined. Accordingly, the insertion resistance caused by the resilient restoring forces accompanying the deformed lock arms 13 will not hinder the insertion of the auxiliary housing 20. Therefore the lock arms 13 and the locks 21 reliably engage and reliably lock the auxiliary housing 20.

The movable locking surfaces 17 on the lock arms 13 cause the lock arms 13 to function as resistance arms and the fixed locking surfaces 23 on the locks 21 cause the locks 21 to function as the resistance generating portions. In this way, the lock arms 13 double as the resistance arms and the locks 21 double as the resistance generating portions. Thus, the structures of the frame 10 and the auxiliary housings 20 are simplified.

Figure 8:
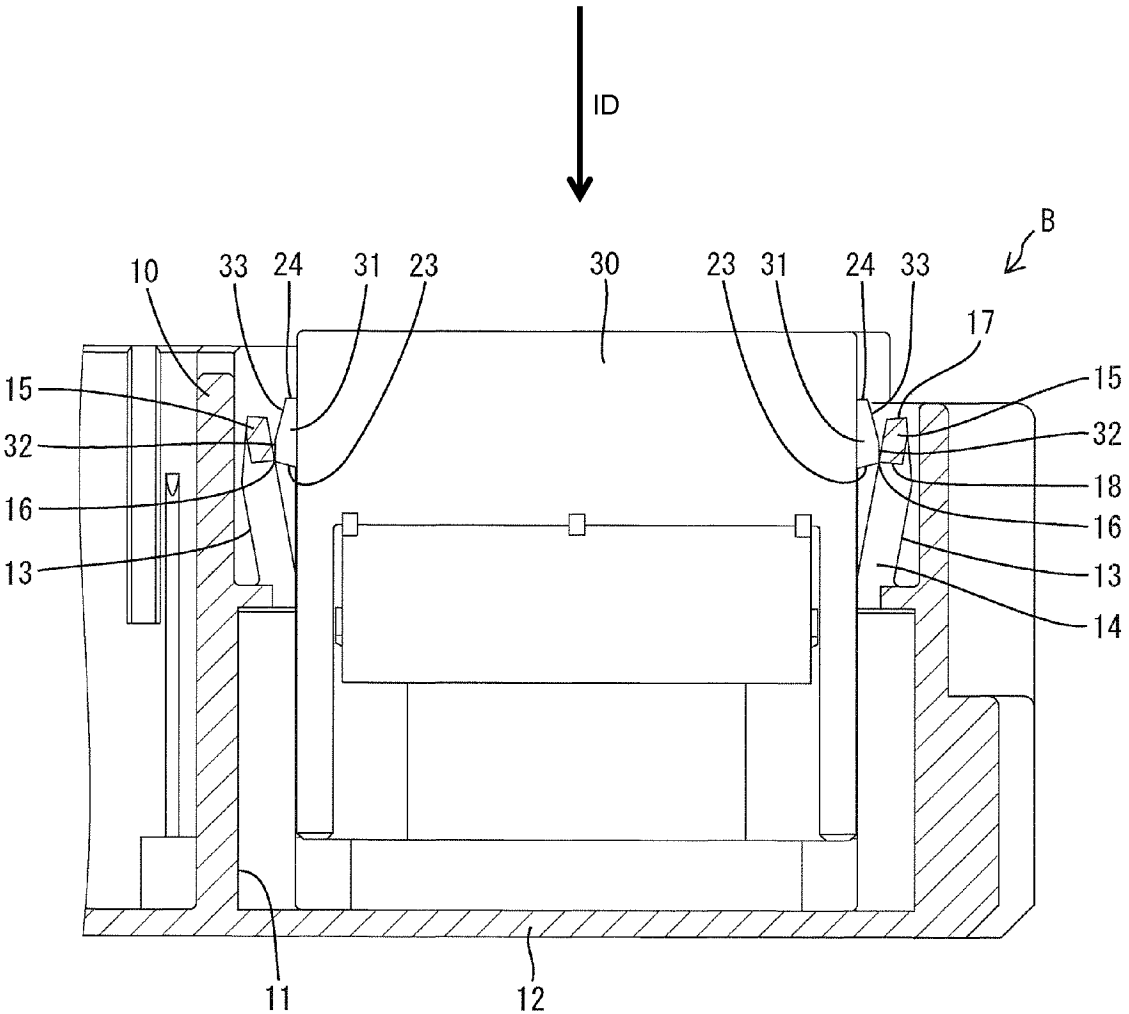
FIG. 8 is a section showing a state where insertion of an auxiliary housing is in progress after locking surfaces are disengaged in a split connector of a second embodiment.

A second embodiment of the invention is described with reference to FIG. 8. A split connector B of the second embodiment differs from the first embodiment in lock portions 31 of auxiliary housings 30. Since the other construction is the substantially same as in the first embodiment, the similar or identical parts are identified by the same reference numerals, but structures, functions and effects thereof are not described.

The locks 31 of each auxiliary housing 30 of the second embodiment differ from the locks 21 of the first embodiment in that guiding slopes 33 are formed at upper end areas of fixed sliding-contacts 32. Movable sliding-contacts 16 of lock arms 13 slide on the guiding slopes 33 in an insertion process of the auxiliary housing 30. The guiding slopes 33 are inclined with respect to an inserting direction ID of the auxiliary housing 30 into an accommodation space 11. In other words, the upper end edges of the guiding slopes 33 are closer to outer side surfaces of the auxiliary housing 30 than the lower end edges of the guiding slopes 33 in the lateral direction. These inclinations are in directions to gradually displace the resiliently deformed lock arms 13 toward the auxiliary housing 30 (resilient restoring directions toward a locked state) while the both sliding-contacts 16, 32 are sliding on each other as the auxiliary housing 30 is inserted.

Accordingly, in the insertion process of the auxiliary housing 30, resilient restoring forces of the lock arms 13 are transmitted to the guiding slopes 33 via the movable sliding-contact portions 16 and a pressing force in the inserting direction ID is applied to the auxiliary housing 30 by the inclinations of the guiding slopes 33 after the movable locking surfaces 17 and the fixed locking surfaces 23 are disengaged. In this way, the auxiliary housing 30 can reliably reach a proper insertion position.

The invention is not limited to the above described and illustrated embodiments. For example, the following embodiments are also included in the technical scope of the present invention.

The lock arms double as the resistance arms in the above embodiments. However, the resistance arms may be provided separately from the lock arms. In this case, one, three or more resistance arms may be provided.

The locks double as the resistance generating portions in the above embodiments. However, the resistance generating portions may be provided separately from the locks. In this case, more or fewer resistance generating portions may be provided.

The lock arms are in the frame and the locks are provided on the auxiliary housing in the above embodiments. Conversely, the lock arms may have the auxiliary housing and the locks may be in the frame.

The resistance arms are in the frame and the resistance generating portions are on the auxiliary housings in the above embodiments. However, the resistance arms may be on the auxiliary housings and the resistance generating portions may be in the frame.

The guiding slopes are formed only on the sliding-contacts of the locks in the second embodiment. However, they may be formed only on the sliding-contact portions of the lock arms or on the sliding-contacts of the locks and the lock arms.

What is claimed is:

1. A split connector, comprising:

a frame having opposite front and rear ends and plurality of accommodating spaces between the ends, the accommodating spaces being open at the front end of the frame;

a plurality of auxiliary housings, each of the auxiliary housings having opposite front and rear ends and opposite sides surfaces, the front end of each of the auxiliary housings being configured to be inserted into one of the accommodating spaces from the front end of the frame;

locks projecting out on the side surfaces of each of the auxiliary housings, each of the locks having a forwardly facing flat fixed locking surface, a rearwardly facing flat fixed locking surface and a flat fixed sliding contact surface facing out on the respective auxiliary housing and extending from the forwardly facing flat fixed locking surface to the rearwardly facing flat fixed locking surface, each of the forwardly and rearwardly facing flat fixed locking surfaces being sloped rearward so as to project more rearward at positions farther out from the respective side surface;

resiliently deformable lock arms cantilevered forward on inwardly facing surfaces of the accommodating spaces of the frame and aligned with the locks when the auxiliary housing is inserted into the respective accommodating space, each lock arm having a forwardly facing flat movable locking surface, a rearwardly facing flat movable locking surface, a flat movable sliding contact surface facing into the respective accommodating space and a lock hole rearward of the rearwardly facing flat movable locking surface and configured for engaging one of the respective locks, the forwardly facing flat movable locking surfaces being sloped to make surface contact with the forwardly facing flat fixed locking surfaces of the locks to generate resistance when the auxiliary housing is inserted into the accommodating space, the movable sliding contact surface being aligned to slide in contact with the fixed sliding contact surface as the respective auxiliary housing is being inserted into the accommodating space and the rearwardly facing flat movable locking surface on the resiliently deformable lock arms being sloped to make surface contact with the rearwardly facing flat fixed locking surfaces of the locks when the auxiliary housing is inserted fully into the accommodating space so that the auxiliary housing is locked in a retained state in the frame by the locking action of the lock arms and the locks, whereby insertion forces to overcome frictional forces between the fixed and movable sliding contact surfaces urge the respective auxiliary housing fully into the accommodating space.

2. The split connector of claim 1, wherein at least the sliding-contact portions of the lock arms or the sliding contacts of the locks are formed with guiding slopes oblique to the inserting direction of the auxiliary housing.

3. The split connector of claim 2, wherein inclinations of the guiding slopes are oriented so that resilient restoring forces of the lock arms generate a pressing force in an inserting direction on the auxiliary housing during insertion of the auxiliary housing.

4. A split connector, comprising:

a frame having a plurality of accommodation spaces each of which has an open front end and two resiliently deformable lock arms cantilevered forward and into the accommodation space, each of the lock arms having a flat front movable locking surface facing toward the open end, a flat rear movable lock surface facing away from the open end, a flat movable sliding contact surface facing into the respective accommodating space and a lock hole rearward of the rearwardly facing flat movable locking surface, the flat front and rear movable locking surfaces being sloped to lie more rearward at positions farther into the accommodation space; and auxiliary housings having a front end configured for insertion respectively into the accommodation space, two locks formed on side surfaces of each of the auxiliary housings and disposed for contacting the lock arms, each of the locks being configured for fitting in the lock hole of one of the lock arms and having a flat front fixed locking surface facing toward the front end and aligned for surface contact with the flat front movable locking surface of the respective lock arm when the auxiliary housing is being inserted into the respective accommodation space a flat rear fixed lock surface facing away from the front end and engaging the flat rear movable lock surface with surface contact when the auxiliary housing is inserted completely into the accommodation space, and a flat fixed sliding contact surface facing out on the respective auxiliary housing and extending from the forwardly facing flat fixed locking surface to the rearwardly facing flat fixed locking surface, the lock arm being resiliently deformed to disengage the flat front locking surfaces by applying an inserting force exceeding a locking force of the flat front locking surfaces to the auxiliary housing, whereby insertion forces to overcome frictional forces between the fixed and movable sliding contact surfaces urge the respective auxiliary housing fully into the accommodating space.

5. The split connector of claim 4, wherein the flat front fixed locking surface and the flat front movable locking surface are aligned at substantially equal acute angles to an insertion direction.

* * * * *